United States Patent [19]

Levy et al.

[11] 4,442,948

[45] Apr. 17, 1984

[54] DRINKING VESSEL

[76] Inventors: Richard C. Levy, 6737 Newbold Dr., Bethesda, Md. 20817; Bryan McCoy, 3139-9 University Blvd., Kensington, Md. 20795

[21] Appl. No.: 418,653

[22] Filed: Sep. 16, 1982

[51] Int. Cl.[3] ..... A47G 19/22; G09F 3/00

[52] U.S. Cl. ..... 220/90.2; D7/6; 40/324; 206/218; 215/1 A; 222/81; 229/7 S

[58] Field of Search ..... 220/69, 90.2, 90.4, 220/90.6, 1 R; 229/7 S, 7 R; 215/1 A; 206/217, 206/218; D7/6, 11; 222/81, 131, 575, 566; 30/124; 40/324, 310, 306, 412, 422; 46/1 R; 239/24, 33

[56] References Cited

U.S. PATENT DOCUMENTS

| | | | |
|---|---|---|---|
| 2,196,450 | 4/1940 | Forgaard | 40/324 |
| 2,263,947 | 11/1941 | Gottfried | 220/90.2 |
| 2,278,586 | 4/1942 | Potter | D7/6 X |
| 2,599,919 | 6/1952 | Hucknall | 220/90.6 |
| 2,763,142 | 9/1956 | Hepner | 40/324 |
| 2,885,134 | 5/1959 | Cohen | 229/7 S X |
| 3,517,884 | 6/1970 | Horvath | 239/33 |
| 3,558,033 | 4/1969 | Leeds | 220/90.2 X |
| 3,606,156 | 9/1971 | Homorodean, Jr. et al. | 220/90.2 |
| 3,774,804 | 2/1972 | Henning | 220/90.2 |
| 3,782,195 | 1/1974 | Meek et al. | 40/324 X |
| 4,016,998 | 4/1977 | Finch | 220/90.2 |
| 4,049,157 | 9/1977 | Carson | 222/81 |
| 4,211,024 | 7/1980 | Nickell | 239/33 X |
| 4,291,814 | 9/1981 | Conn | 220/90.4 |

FOREIGN PATENT DOCUMENTS

| | | | |
|---|---|---|---|
| 600 | 2/1979 | European Pat. Off. | 221/81 |

*Primary Examiner*—William Price
*Assistant Examiner*—Gary E. Elkins
*Attorney, Agent, or Firm*—Cushman, Darby & Cushman

[57] ABSTRACT

A drinking vessel formed of a separable outer shell and inner shell which form a fluid flow path therebetween when the inner shell is received in the outer shell. Removal of the inner shell renders the flow path accessible for cleaning. The outer shell is transparent in the vicinity of the flow path to display fluid flow through the path. Embodiments having various configurations of flow paths are disclosed. An embodiment including a mechanism for puncturing a disposable inner shell to provide access between the flow path and interior of the inner shell is also disclosed.

18 Claims, 17 Drawing Figures

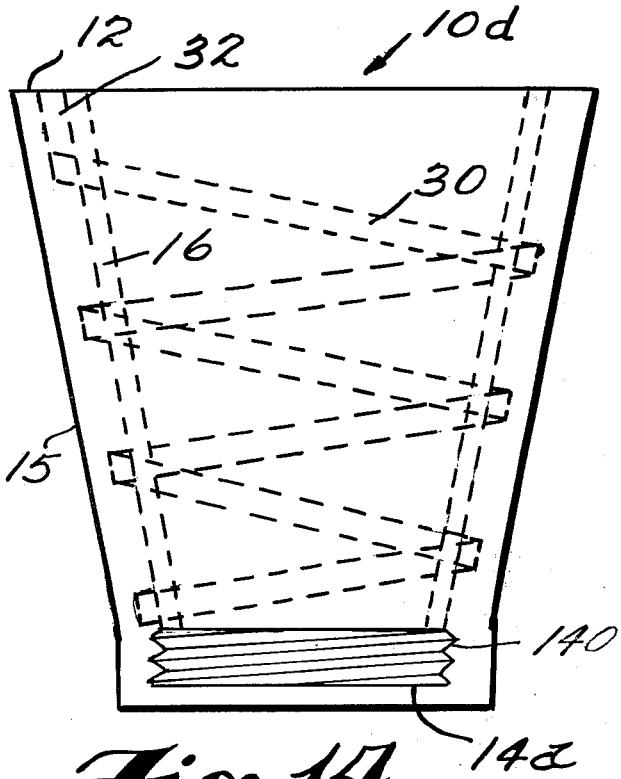
Fig. 14.
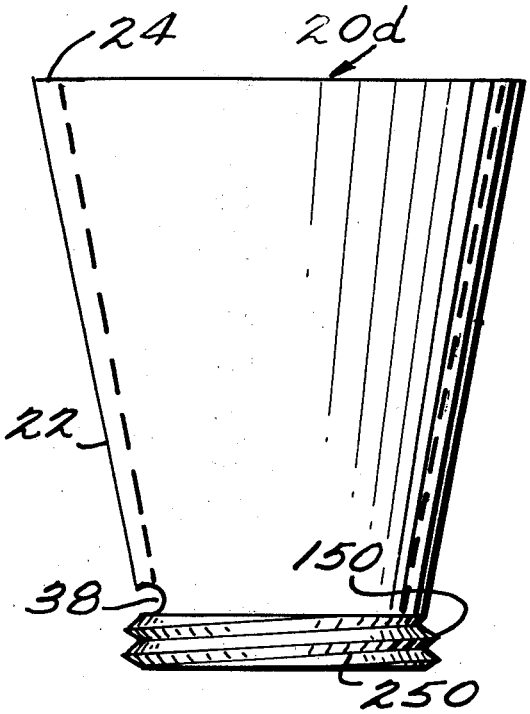
Fig. 15.
Fig. 16.
Fig. 17.
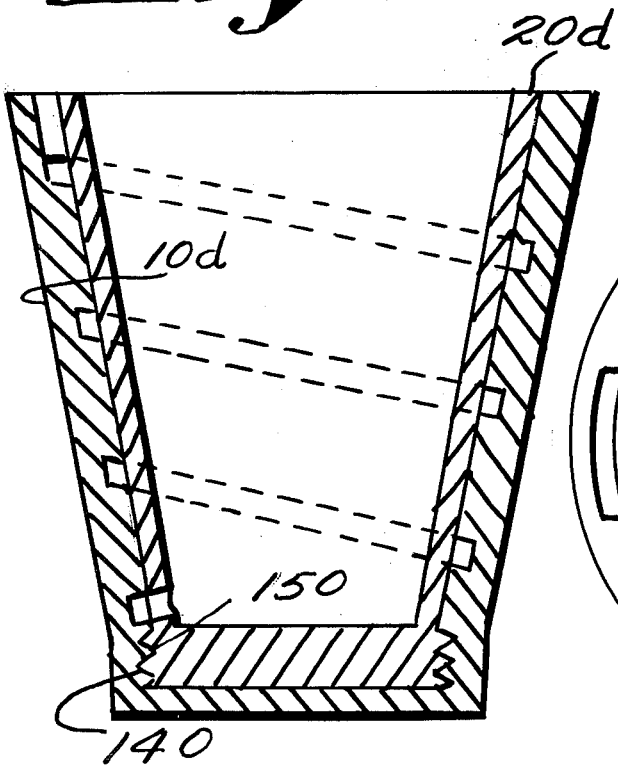
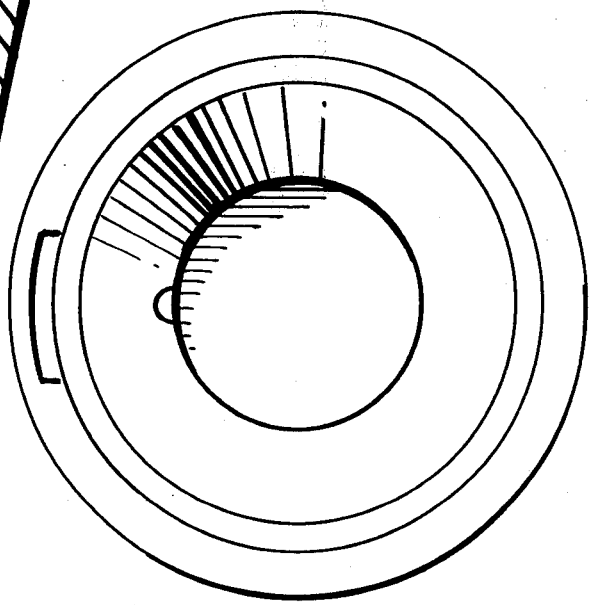

DRINKING VESSEL

BACKGROUND OF THE INVENTION

1. Field of the Invention

The present invention relates to drinking vessels, and in particular to drinking vessels which include integral provisions for defining flow paths through which the fluid contained in the cup may be drawn.

2. Description of the Prior Art

In general, drinking vessels including integral provisions for defining flow paths through which fluid may be drawn are known. For example, drinking vessels including integral straws are described in U.S. Pat. No. 3,558,033 issued to L. D. Leeds on Jan. 26, 1971, U.S. Pat. No. 3,774,804 issued to S. A. Henning on Nov. 27, U.S. Pat. No. 4,016,998 issued to L. Finch on Apr. 12, 1977 and U.S. Pat. No. 4,291,814 issued to J. L. Conn on Sept. 29, 1981.

Similarly, drinking straws for defining a convoluted flow path, typically spiral, are also well-known. Examples, of such convoluted drinking straws are described in U.S. Pat. No. 3,517,884 issued to S. D. Horvath on June 30, 1970 and 3,606,156 issued to J. Homorodean, Jr. et al on Sept. 20, 1971. However, the prior art integral straw drinking vessels and convoluted straws are disadvantageous in that they cannot readily be cleaned. Specifically, the interior of the fluid path is not accessible for thorough cleaning, and accordingly there is a tendency for bacteria to grow and accumulate within the fluid path. Accordingly, such cups and straws are not suitable for commercial uses.

SUMMARY OF THE INVENTION

The present invention provides a drinking vessel wherein an integral flow path is defined but is fully accessible for cleaning.

In accordance with one aspect of the present invention, a drinking vessel is formed of separable inner and outer shells. The inner wall provides a liquid container having an aperture near the bottom thereof. The outer (or inner) wall is contoured so that portions of the outer and inner (outer) wall come into contact to provide a specific fluid path running from the aperture near the bottom of inner wall to an exit disposed at the mouth of the vessel. The outer and inner walls thus cooperate to form a fluid flow path of a predetermined configuration. When the inner and outer walls are separated, the interior of the flow path is accessible for cleaning.

In accordance with another aspect of the invention, an outer shell is provided for use with a puncturable cup, such as a styrofoam cup, as the inner shell. A mechanism is provided to puncture the styrofoam cup to provide communication with the fluid pathway.

In accordance with another aspect of the invention, an inner shell is provided which is adapted to be received in a standard drinking vessel, and forms the pathways between the interior wall of the drinking vessel and the exterior surface of the inner shell.

BRIEF DESCRIPTION OF THE DRAWING

Preferred exemplary embodiments of the present invention will hereinafter be described in conjunction with the appended drawing wherein like numerals denote like elements and:

FIG. 14 is a side view of a further embodiment of the outer shell of drinking vessel in accordance with the present invention adapted for threaded coupling with an inner shell;

FIG. 15 is a side view of an inner shell in accordance with the present invention for cooperation with the outer shell of FIG. 14;

FIG. 16 is a sectional elevation view of the embodiment of FIGS. 14 and 15;

FIG. 17 is a top view of the embodiment of FIGS. 14 and 15.

DETAILED DESCRIPTION OF THE PREFERRED EXEMPLARY EMBODIMENTS

Figure 1:
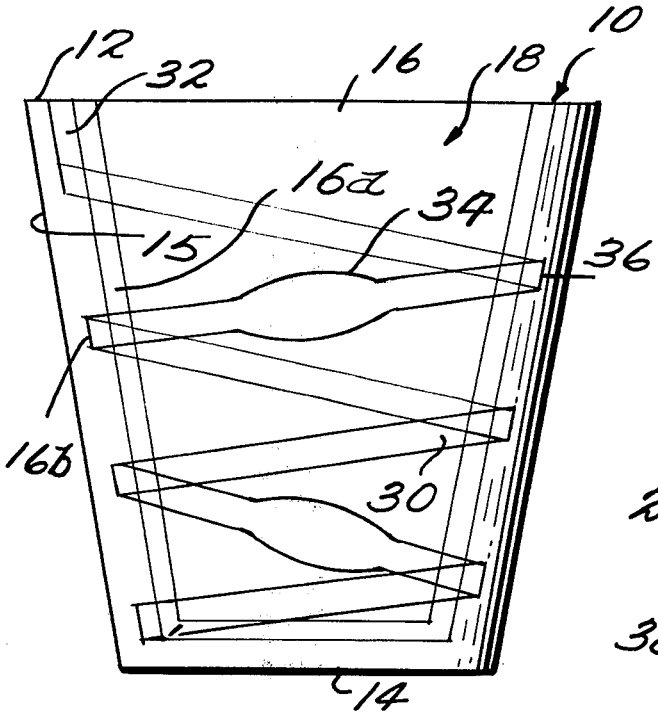
FIG. 1 is a side view of the outer shell of a first embodiment of a drinking vessel in accordance with the present invention.

Referring now to FIGS. 1, 2, 3 and 4, a first embodiment of the present invention comprises an integrally formed outer shell 10 suitably formed of a relatively rigid transparent material, such as plastic. Outer shell 10 is formed of a generally cylindrical side wall 15 terminating at a lip or rim 12 at one extremity, and a base member 14 at the other. Interior surface 16 of sidewall 15 cooperates with base member 14 to define a cavity 18 of predetermined dimensions, which is adapted to receive an inner shell 20. Inner shell 20 includes an exterior sidewall 22, generally conforming in shape to the inner sidewall 16 of outer shell 10. Inner shell 20 is formed by an inner shell sidewall 22 terminating at one end in a rim or lip 24, and at the other of a base member 25. Inner shell side wall 22 and base member 25 cooperate to define an interior cavity (reservoir) 26.

Shell 20 is suitably opaque, and may bear suitable indicia 28 such as a company logo, or picture or the like, on the exterior surface of sidewall 22.

Inner shell 20 is received in cavity 18 of outer shell 14, and is removably secured therein, suitably by a snap fit arrangement (not shown) or a friction fit between the exterior surface of inner shell sidewall 22 and outer shell interior side wall 16. Alternatively, base members 14 and 25 may include mating threads, as will be described in conjunction with FIGS. 14–17.

Outer shell sidewall interior surface 16 and inner shell exterior sidewall 22 cooperate to define one or more fluid paths between inner shell 10 and outer shell 20. More specifically, a channel 30 is formed in outer shell interior wall 16 by respective projecting portions 16*a* and recessed portions 16*b* of the interior wall 16. Channel 30 extends from the bottom of cavity 18 near base member 14 to an exit 32 in lip 12 of outer shell 10. Channel 30 may be in any configuration, such as a spiral, disposed around interior side wall 16. Alternatively, channel 30 can be disposed on only a portion of sidewall 16. Channel 30 may be of constant width throughout or may vary in width, depth, or both concurrently, to vary the apparent flow pattern of the liquid, as will be explained.

When inner shell 20 is received in cavity 18, inner shell exterior sidewall 22 comes into substantially sealing relationship with projecting portions 16*a* of outer shell sidewall 16, while recessed portion 16*b* are removed from the side wall. Thus, a closed channel 30 is formed between recessed portions 16*b* and inner shell 20 to provide a defined flow path from the bottom of cavity 18 to exit 32 at the lip of the cup.

An aperture 38 is provided at the bottom of inner shell 20, disposed for registry with channel 30 when inner shell 20 is received in cavity 18. Thus, fluid communication between reservoir 26 and exit 32 is provided through aperture 38 and channel 30. Accordingly, when suction is applied at exit 32, liquid is drawn from reservoir 26 through channel 30 to exit 32 for consumption.

After use, inner shell 20 is removed. The interior of channel 30 is thus rendered accessible for complete and adequate cleaning to ensure that no bacteria is permitted to grow.

As previously noted, the flow of liquid through the various portions of channel 30 can be controlled by varying the width or depth of channel 30. For example, by widening the channel such as shown at point 34 while maintaining constant depth (i.e., increasing volume) in a given portion of the channel, fluid flow through that channel appears to slow down. Similarly, by decreasing the depth of the channel in a given area without changing the width (decreasing the volume of the channel), such as shown at point 36, causes an apparent increase in the speed of the liquid through that portion of the channel. Alternatively, the channel can be widened without changing the apparent speed of the liquid by decreasing the channel depth to maintain constant volume.

Figure 5:
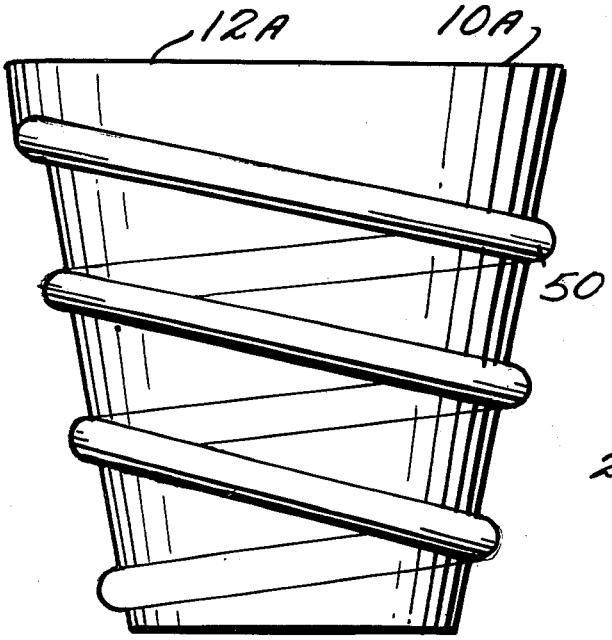
FIG. 5 is a second embodiment of the outer shell of a drinking vessel in accordance with the present invention.
Figure 6:
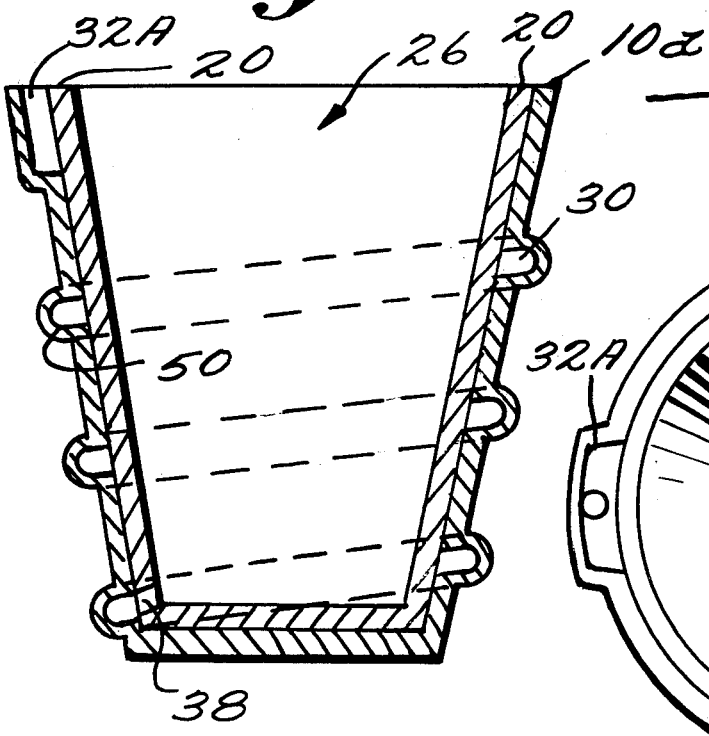
FIG. 6 is a sectional elevation view of the outer shell of FIG. 5 cooperating with the inner shell of FIG. 2.
Figure 7:
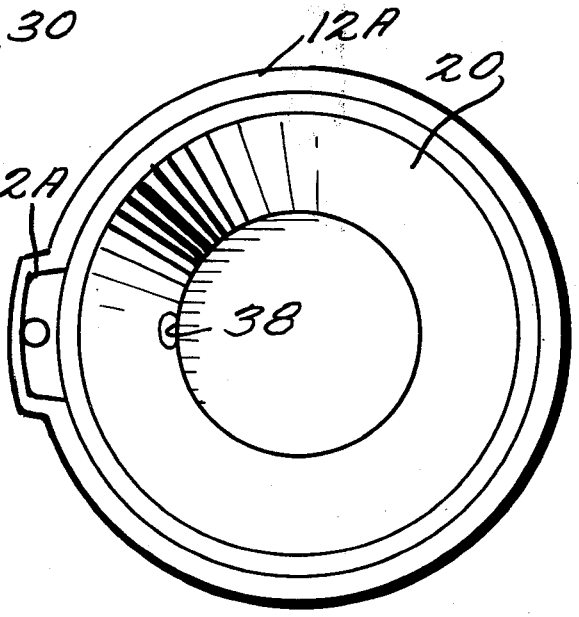
FIG. 7 is a top view of the embodiment of FIGS. 5 and 6.

It should also be appreciated that channel 30 can be formed by contouring of outer shell 10. Such an embodiment is shown in FIGS. 5 and 6. Portions 50 of outer shell 10*a* project outwardly to form channel 30. As in the embodiment of FIGS. 1–4, inner shell 20 is received within outer shell 10*a* to close channel 30 and form a fluid flow path from the interior reservoir 26 of inner shell 20 to an exit 32*a* formed as an outwardly projecting portion of lip 12*a*.

Figure 8:
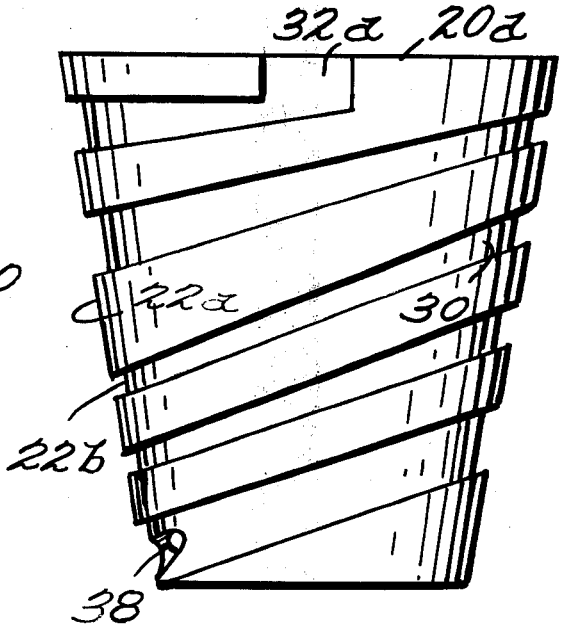
FIG. 8 is a side view of an inner shell in accordance with the present invention adapted for cooperation with conventional drinking vessels.

It should be appreciated that the means for forming the fluid path can be disposed on the exterior surface 22 of inner shell 20, and that an inner shell 20 can be provided for cooperation with standard drinking glasses of an appropriate size. More specifically, referring to FIG. 8, an inner shell 20*a* is contoured to include projecting sidewall portions 22*a* and recessed sidewall portions 22*b*. Projecting portions 22*a* and recessed portions 22*b* define channel 30 therebetween. Aperture 38 again communicates between the interior of inner shell 20*a* and channel 30. When disposed within a drinking vessel of appropriate size (outer shell) projecting portions 22*a* come into substantially sealing relation with the interior surface of the vessel, to complete the channel. Exit 32*a* would be provided as a recessed portion in the lip of inner shell 20*a*. Thus, inner shell 20*a* can be utilized with any conventional drinking glass of appropriate size (and preferably transparent) to provide what is, in effect, an integral drinking straw. Again, when inner shell 20*a* is removed from the drinking vessel, the entirety of channel 30 is accessible for cleaning.

Figure 9:
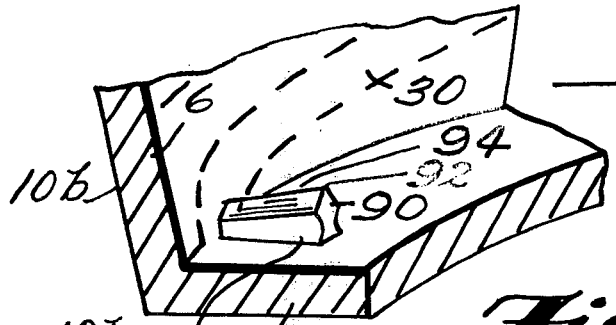
FIG. 9 is a partial pictorial of an outer shell in accordance with the present invention including means for puncturing the inner shell.
Figure 10:
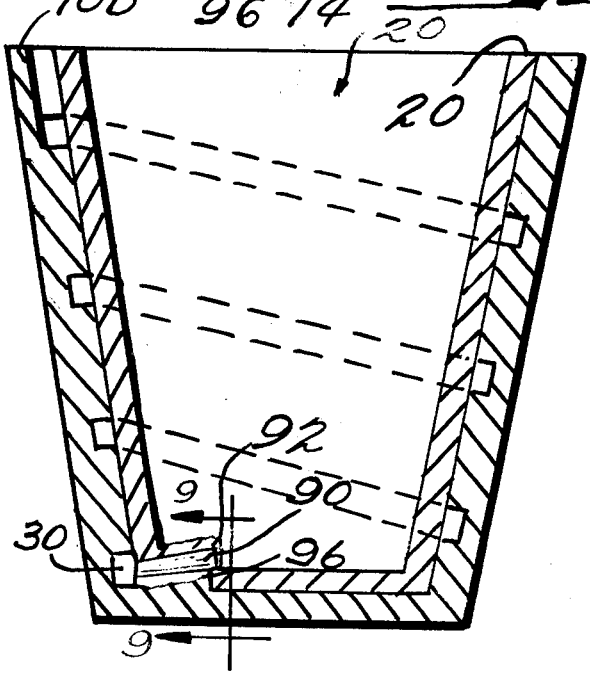
FIG. 10 is a section elevation view of the outer shell of FIG. 9 cooperating with a puncturable inner shell.
Figure 11:
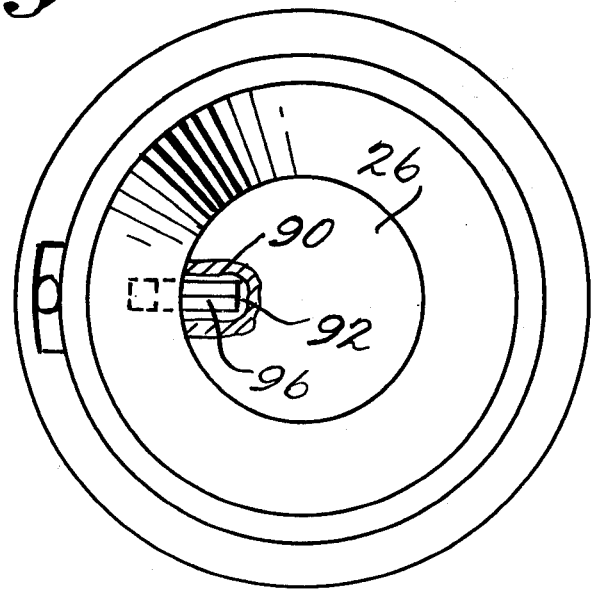
FIG. 11 is a top view of the embodiment of FIG. 10.

Similarly, an outer shell can be provided for receiving a disposable cup made of puncturable material such as paper or styrofoam as an inner shell. Referring to FIGS. 9, 10 and 11, such an outer shell 10*b* would be identical to outer shell 10 or 10*a*, but includes a puncturing member 90 disposed on the inner surface of base member 14 proximate to the end of channel 30.

Puncturing member 90 suitably comprises a parallelepiped or triangular member slanted to present a point 92 and a relatively sharp edge 94 to the base and sidewall of the inner shell as it is received in outer shell 10*b*. Grooved sides 96 are provided to permit fluid passage. When a puncturable inner shell such as a styrofoam cup is received in outer shell 10*b*, point 92 and edge 94 of member 90 puncture the bottom and lower sidewall of inner shell 20. When inner shell 20 is fully received by outer shell 10*b*, puncturing member 90 is substantially received within inner cavity 26, and grooved sides 96 provide for fluid communication from the reservoir 26 to channel 30.

As previously noted, the flow path can be in any configuration, and can widen or narrow arbitrarily. The flow path can extend around the circumference of the outer shell, or can be confined to a single area or portion of the shell, e.g., one face. Similarly, a plurality of flow paths or a flow path having a plurality of branches can communicate with a single exit.

Figure 2:
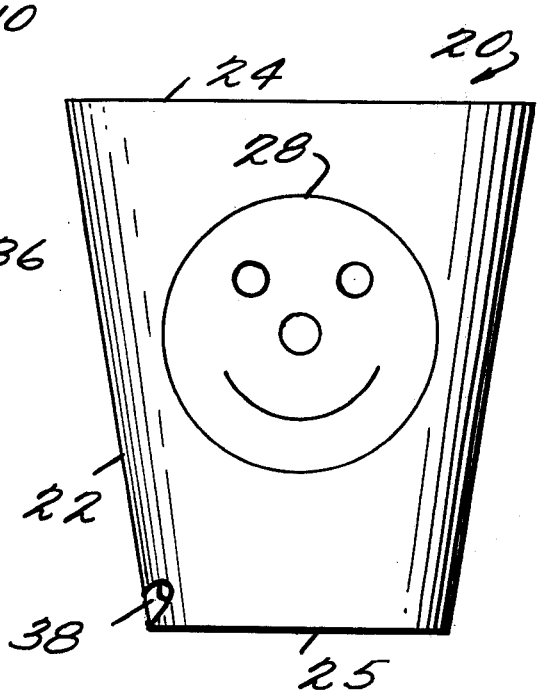
FIG. 2 is a side view of the first embodiment of a drinking vessel in accordance with the present invention.
Figure 3:
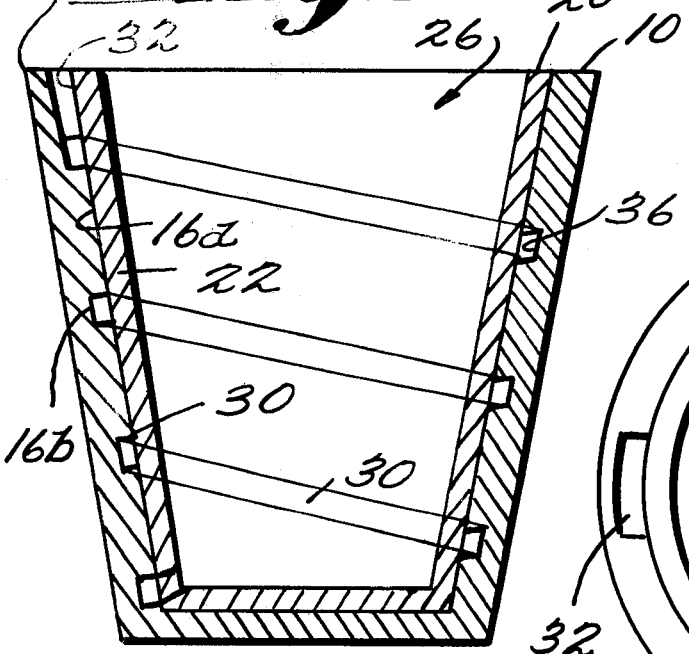
FIG. 3 is a sectional elevation view of the embodiment of FIGS. 1 and 2.
Figure 4:
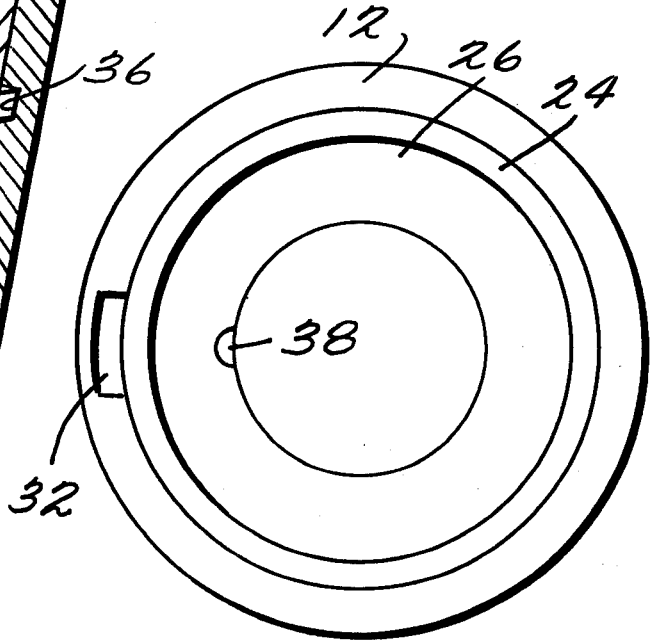
FIG. 4 is a top view of the embodiment of FIGS. 1 and 2.
Figure 12:
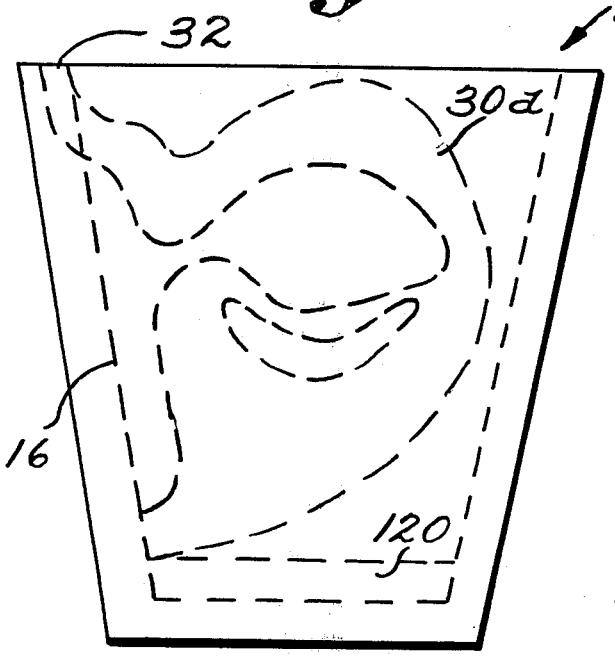
FIG. 12 is a side view of another embodiment of the outer shell of a drinking vessel in accordance with the present invention.
Figure 13:
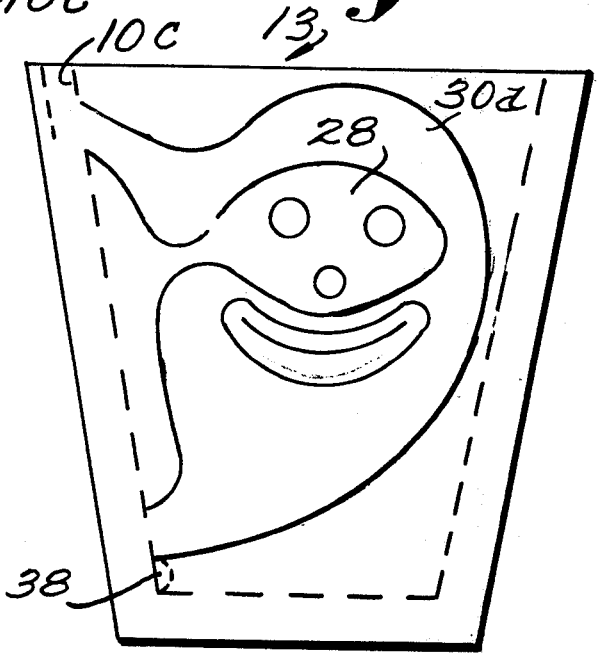
FIG. 13 is a side view of the outer shell of FIG. 12 cooperating with the inner shell of FIG. 2.

In addition, the flow path can be configured to cooperate with the indicia 28 disposed on inner shell 20. An example of such a path configuration is shown in FIGS. 12 and 13. Referring to FIGS. 12 and 13, an outer shell 10*c* includes a flow path 30*a*. Flow path 30*a* is configured such that when inner shell 20 (such as illustrated in FIG. 2) is disposed within the cup, indicia 28 is disposed in predetermined relation to path 30*a*. Specifically, in the illustrated example, path 30*a* appears to provide a beard, mustache and cap for the face 28*a*. When liquid is drawn from the interior of inner shell 20 through path 28*a*, the mustache, beard and cap are emphasized by the liquid flow. If desired, channel 30*a* can include a portion 120 extending completely around the periphery of interior sidewall 16 just above bottom member 14, and a plurality of different indicia provided on inner shell 20. Thus, by rotating inner shell 20, channel 30*a* can be made to visually interact with the various different indicia on inner shell 20.

As previously noted, inner shell 20 is suitably retained in outer shell 10 by a snap or friction fit between the respective shells. In some cases, however, it may be desirable to provide a more secure coupling between the shells. Referring to FIGS. 14, 15, 16 and 17, the base members 14*d* and 25*d* of an outer shell 10*d* an inner shell 20*d* are provided with female and male threads 140 and 150, respectively. Inner shell 20*d* is received in outer shell 10*d*, and secured by the mating of the threads 140 and 150.

It will be understood that the above description is of preferred exemplary embodiments of the present invention and that the invention is not limited to the specific form shown. Modifications may be made in the design and arrangement of the elements without departing from the spirit of the invention as expressed in the appended claims.

What is claimed is:

1. A drinking vessel comprising:

an inner shell and an outer shell, said outer shell being adapted to removably receive said inner shell in the interior thereof; and means for forming at least one fluid flow path of predetermined non-linear configuration between said inner and outer shells, the interior of said fluid flow path being substantially exposed to facilitate cleaning when said inner shell is removed from said outer shell;

said outer shell including a transparent portion disposed to display fluid flow through at least a portion of said non-linear fluid flow path;

said inner shell including at least one aperture disposed to communicate between the interior of said inner shell and said fluid flow path when said inner shell is received by said outer shell;

said fluid flow path including an access to a user when said inner shell is received by said outer shell, whereby said user can draw fluid from the interior of said inner shell through said aperture into said fluid path and through said fluid path access.

2. The drinking vessel of claim 1 wherein said means for forming at least one fluid flow path comprises:

projecting portions formed on at least said inner shell exterior surface, and adapted to extend into sealing relationship with corresponding portions of said outer shell interior surface.

3. The drinking vessel of claim 1 wherein said means for forming at least one fluid flow path comprises:

a channel formed in the interior surface of said outer shell, said channel being adapted to be sealed by a corresponding portion of said exterior surface of said inner shell.

4. The drinking vessel of claim 1 wherein said fluid flow path varies in volume along the extent of said portion such that the velocity of fluid drawn therethrough varies.

5. The drinking vessel of claim 1 wherein said fluid path portion is configured to form a predetermined shape.

6. The drinking vessel of claim 1 wherein said fluid flow path varies in visible width along said portion of said flow path.

7. The drinking vessel of claim 1, or 4 wherein said inner shell is opaque.

8. The drinking vessel of claim 7 wherein said inner shell displays visual indicia.

9. The drinking vessel of claim 1 wherein said means for forming at least one fluid flow path comprises:

a channel formed in the exterior surface of said inner shell, said channel being adapted to be sealed by a corresponding portion of the interior surface of said outer shell.

10. The drinking vessel of claim 9 wherein said fluid flow path varies in volume along the extent of said portion such that the velocity of fluid drawn therethrough varies.

11. The drinking vessel of claim 9 wherein said fluid flow path varies in visible width along said portion of said flow path.

12. The drinking vessel of claim 1 wherein said means for defining said fluid flow path comprises a generally helical projection disposed on the interior surface of said outer shell, adapted for sealing relationship with the exterior surface of said inner shell.

13. The drinking vessel of claim 1 further including visual indicia disposed in predetermined relation with said fluid flow path to cooperate with said fluid flow to present a variable display through said outer shell transparent portion.

14. A drinking vessel comprising:

an outer shell, having an interior surface and a lip, adapted to removably receive a puncturable inner shell;

means for defining at least one fluid flow path along said outer shell interior surface, said flow path including an exit proximate to the lip of said outer shell and being substantially exposed to facilitate cleaning when an inner shell is not received in said outer shell and completed by reception of said inner shell in said outer shell to form said fluid flow path; and means disposed in the interior of said outer shell for puncturing said inner shell to effect fluid communication between the interior of said inner shell and said channel.

15. The drinking vessel of claim 14 wherein means for defining said fluid flow path comprises a generally helical projection disposed on the interior surface of said outer shell, adapting for sealing relationship with the exterior surface of said inner shell.

16. The drinking vessel of claim 14 wherein said means for forming at least one fluid flow path comprises:

a channel formed in the interior surface of said outer shell, said channel being adapted to be sealed by a corresponding portion of said exterior surface of said inner shell.

17. The drinking vessel of claim 14, 15 or 16 wherein said outer shell is transparent at least in the vicinity of a portion of said fluid flow path.

18. The drinking vessel of claim 17 wherein said fluid flow path varies in volume along the extent of said portion such that the velocity of fluid drawn therethrough varies.

* * * * *